US008038453B2

(12) United States Patent
Robicheau et al.

(10) Patent No.: US 8,038,453 B2
(45) **Date of Patent: *Oct. 18, 2011**

(54) GROUND CONNECTOR

(75) Inventors: Richard E. Robicheau, Litchfield, NH (US); Michael Rzasa, Nashua, NH (US)

(73) Assignee: Hubbell Incorporated, Shelton, CT (US)

( * ) Notice: Subject to any disclaimer, the term of this patent is extended or adjusted under 35 U.S.C. 154(b) by 332 days.

This patent is subject to a terminal disclaimer.

(21) Appl. No.: 12/380,511

(22) Filed: Feb. 27, 2009

(65) Prior Publication Data

US 2010/0221934 A1 Sep. 2, 2010

(51) Int. Cl.
*H01R 4/66* (2006.01)

(52) U.S. Cl. ..... 439/100

(58) Field of Classification Search ..... 439/100, 439/101, 803, 863, 791, 783; 269/249, 87.3; 24/16 R, 20 R, 22, 23 EE, 23 R, 24, 305, 24/486, 277; 174/78; 248/229.1, 316.1, 248/346.05, 346.06, 74.1

See application file for complete search history.

(56) References Cited

U.S. PATENT DOCUMENTS

| | | | | |
|---|---|---|---|---|
| 774,099 | A | 11/1904 | Narsh | |
| 846,202 | A | 3/1907 | Harrah | |
| 1,056,173 | A | 3/1913 | Higgin | |
| 2,364,419 | A | 12/1944 | Barnes | 256/58 |
| 2,915,268 | A | 12/1959 | Wrobel | |
| 2,942,898 | A | 6/1960 | Matthysse | |
| 3,435,126 | A | 3/1969 | Hamilton | 174/78 |
| 3,861,771 | A | 1/1975 | Cornell | 339/95 R |
| 4,114,977 | A | 9/1978 | Polidori | 339/270 |
| 4,303,216 | A | 12/1981 | Hollingsead | 248/74 PB |
| 4,428,104 | A | 1/1984 | Smith | 24/279 |
| RE31,689 | E | 10/1984 | Bulanda et al. | 24/16 PB |
| 5,286,211 | A | 2/1994 | McIntosh | 439/100 |
| 5,632,633 | A * | 5/1997 | Roosdorp et al. | 439/100 |
| D389,052 | S | 1/1998 | Yamamoto | D8/396 |
| 5,729,872 | A | 3/1998 | Ginocchio | 24/16 R |
| D473,130 | S | 4/2003 | Leung | D8/396 |
| 6,742,223 | B1 | 6/2004 | Chang | 24/16 R |
| 6,763,555 | B2 | 7/2004 | Storer et al. | 24/274 R |
| 6,986,673 | B2 * | 1/2006 | de la Borbolla | 439/100 |
| 7,052,331 | B2 | 5/2006 | Maxwell et al. | 439/758 |
| 7,096,543 | B2 | 8/2006 | Castellanos | 24/16 PB |
| 7,794,243 | B1 * | 9/2010 | Rzasa et al. | 439/100 |
| 7,803,001 | B2 * | 9/2010 | Wason | 439/100 |
| 2008/0202794 | A1 | 8/2008 | Cho | 174/169 |

* cited by examiner

*Primary Examiner* — Edwin A. Leon
(74) *Attorney, Agent, or Firm* — Harrington & Smith

(57) ABSTRACT

A ground connector including a first section and a second section. The first section includes a first member with a threaded post, and a system including a screw configured to clamp the first section against opposite sides of a support. The second section is movably located on the threaded post and configured to directly contact and clamp a conductor towards the support.

18 Claims, 7 Drawing Sheets

GROUND CONNECTOR

BACKGROUND OF THE INVENTION

1. Field of the Invention

The invention relates to a raised floor system and, more particularly, to grounding in a raised floor system.

2. Brief Description of Prior Developments

It is known in raised floor structures, used in a building having numerous computer or telephone or electrical devices, to provide a grounding network. The understructure of a raised floor system includes multiple pedestals and perhaps stringers and seismic supports. Floor panels are located on top of the pedestals. The panels can include, for example, aluminum panels, or steel panels such as hollow, perforated, grated, concrete filled, wood filled and calcium chloride filled.

A grounding network of a raised floor system can comprise ground conductors or cables arranged in a parallel grid or a perpendicular grid. A ground connector is used to connect the cable to the pedestal of the raised floor system. U.S. Pat. No. 5,286,211 discloses a ground connector where conductors can be clamped directly against a post in two orthogonal orientations. There is a desire for a faster and less expensive way to connect a ground conductor to a pedestal of a raised floor system.

SUMMARY

The following summary is merely intended to be exemplary. The summary is not intended to limit the scope of the claimed invention.

In accordance with one aspect of the invention, a ground connector is provide comprising a first section and a second section. The first section comprises a first member with a threaded post, a second member pivotably connected to the first member, and a worm drive on the first member. The second member comprises teeth configured to be engaged by the worm drive to clamp a pedestal directly between the first and second members. The second section is movably located on the threaded post and configured to directly contact and clamp a conductor towards the pedestal.

In accordance with another aspect of the invention, a ground connector is provided including a first section and a second section. The first section includes a first member with a threaded post, and a system including a screw configured to clamp the first section against opposite sides of a support. The second section is movably located on the threaded post and configured to directly contact and clamp a conductor towards the support.

In accordance with another aspect of the invention, a method is provide comprising connecting a first section of a ground connector to a pedestal, wherein the first section comprises a first member with a threaded post, a second member pivotably connected to the first member, and a worm drive on the first member, wherein the second member comprises teeth engaged by the worm drive to clamp a pedestal directly between the first and second members; and positioning a second section on the threaded post to directly contact and clamp a conductor towards the pedestal.

BRIEF DESCRIPTION OF THE DRAWINGS

The foregoing aspects and other features of the invention are explained in the following description, taken in connection with the accompanying drawings, wherein.

DETAILED DESCRIPTION OF EMBODIMENTS

Figure 1:
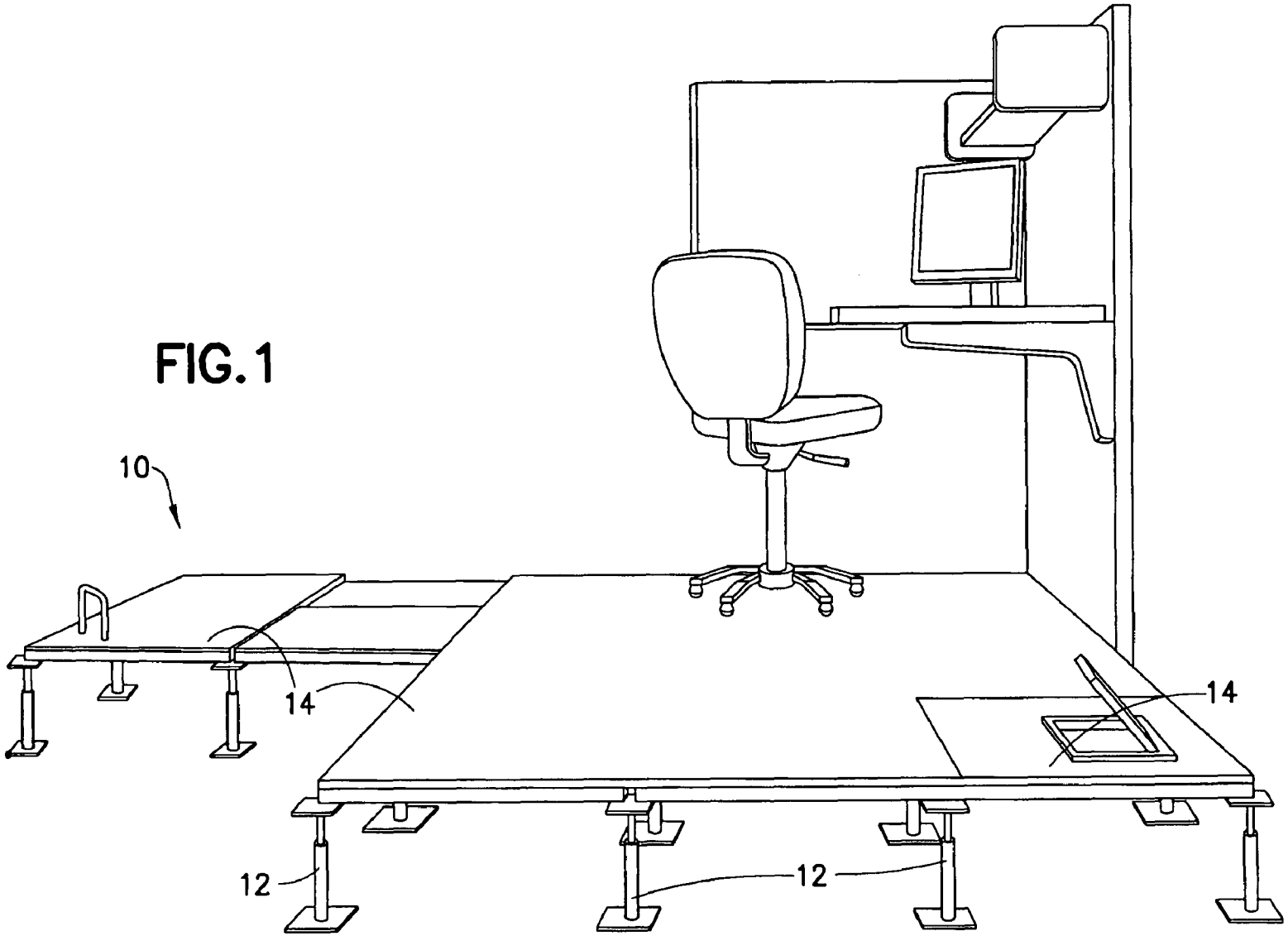
FIG. 1 is a perspective view of a raised floor system comprising features of the invention.

Referring to FIG. 1, there is shown a view of a raised floor system 10 incorporating features of the invention. Although the invention will be described with reference to the example embodiments shown in the drawings, it should be understood that the invention can be embodied in many alternate forms of embodiments. In addition, any suitable size, shape or type of elements or materials could be used.

The system 10 generally comprises pedestals 12 and panels 14. The panels 14 are conventional panels of a raised floor system. Each pedestal 12 generally comprises a first section 16 and a second section 18. The second section 18 is adjustably connected to the first section 16 in this embodiment. However, in alternate embodiments the second section might not be movably connected to the first section. The first section 16 comprises a base 20 and a post 22. The base and post are preferably comprised of metal. In this embodiment the post 22 is stationarily attached to the base, such as by welding. However, in alternate embodiments the base and post could be integrally formed or connected in any other suitable method.

The base 20 is sized and shaped to sit or rest on a floor, such as a concrete floor of an office building for example. The base 20 has a general square or rectangular planar shape, but could have other shapes. In an alternate embodiment the base could be sized and shaped to connect to another member.

The post 22 extends upward from the base 20. The post 22 has a general tube shape. In the embodiment shown the tube shape is generally circular in cross section, but could have alternative cross sectional shapes. An aperture extends into the top end of the post 22 into the central channel of the tube shape.

The second section 18 generally comprises a post 26 and a top support 28. The post 26 and top support 28 are conventional in this embodiment. The post 26 is a threaded post with threads on its exterior side. The top support 28 is connected to the top end of the post 26. The top side of the top support 28 is adapted to support the panels 14 thereon.

The second section 18 comprises an adjuster, such as a nut. The adjuster is connected to the threads of the post 26. The bottom side of the nut rests on the top end of the post 22. In alternate embodiments any suitable type of height adjustment system between the first and second sections could be provided.

The bottom end of the post 26 extends into the center channel of the post 22 through the open top end of the post 22. With the nut resting on the top support surface of the post 22, when the nut is turned the post 26 can move up and down relative to the post 22. Thus, the height of the top support 28 relative to the base 20 can be adjusted.

Figure 2:
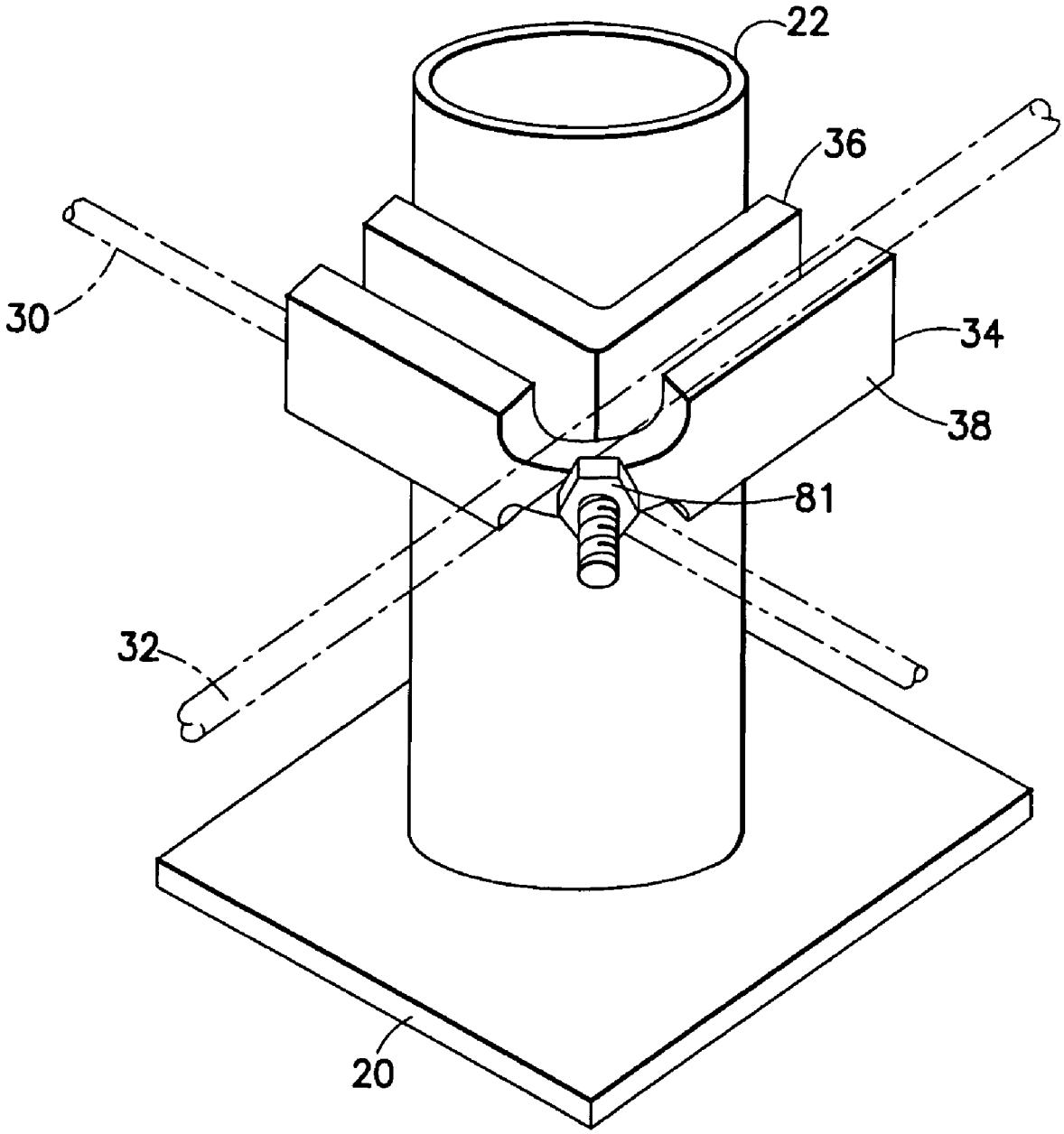
FIG. 2 is a perspective view of an electrical connector attached to one of the pedestals.
Figure 3:
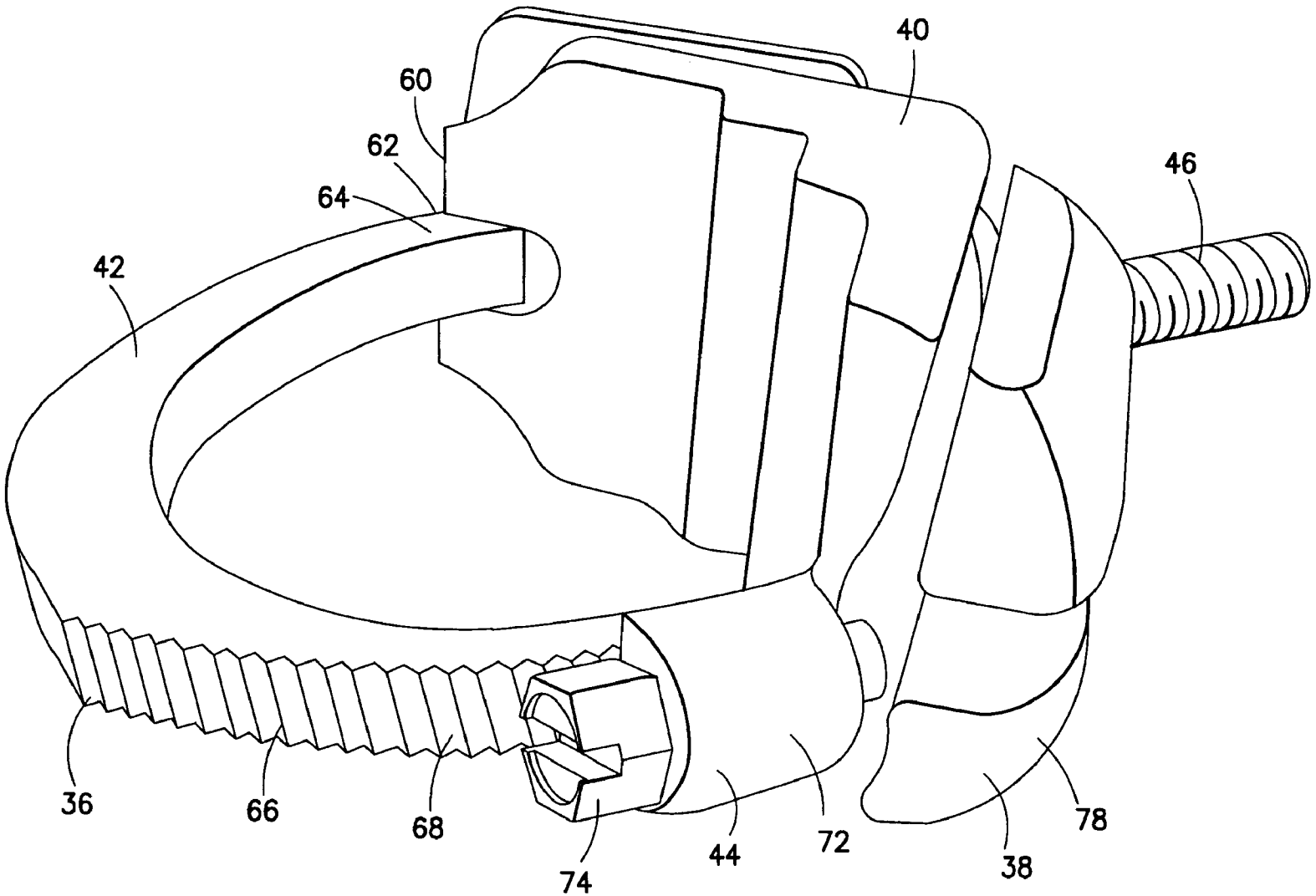
FIG. 3 is a perspective view of the electrical connector shown in FIG. 2.

Referring also to FIG. 2, the system 10 includes a grounding system which is used to ground the raised floor system to ground. The grounding system includes electrical conductors 30, 32 and electrical ground connectors 34. Referring also to FIG. 3, the connector 34 generally comprises a first section 36 and a second section 38. The first section 36 generally comprises a first member 40, a second member 42 and a worm drive 44.

Figure 4:
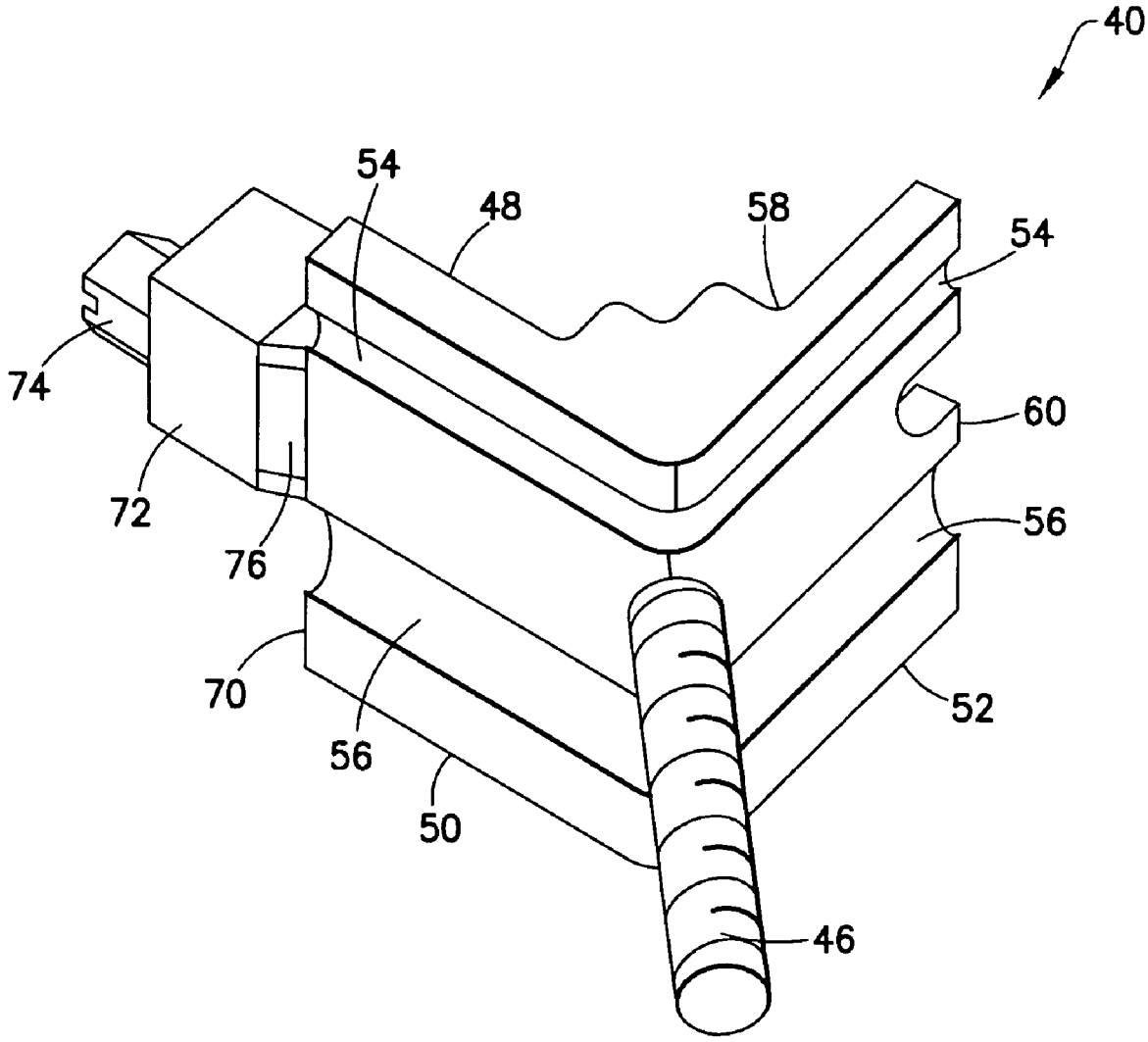
FIG. 4 is a perspective view of one of the members of the connector shown in FIGS. 2-3.

Referring also to FIG. 4, the first member 40 is a one-piece substantially rigid metal member. The first member 40 has a general V shaped member 48 and a threaded post 46. The member 48 has two sections 50, 52 which are generally orthogonal to each other. Exterior facing sides of the sections 50, 52 each have two conductor receiving grooves 54, 56 therealong. In this embodiment the grooves have different sizes, but they could have the same size. The opposite facing side 58 is configured to be located directly against the exterior surface of the post 22.

The second member 42 is pivotably connected to a first end 60 of the first member 40 at pivot connection 62. The second member 42 is a one-piece substantially rigid metal member having a general curved shape. However, the member 42 might not be rigid. A first end 64 is pivotably connected at the pivot connection 62. A side of the second member 42 has teeth 66 which extend to a second end 68 of the second member 42.

The worm drive 44 is located at the second end 70 of the first member 40. The worm drive 44 has a housing 72 formed by part of the first member 40 and a worm screw 74 in the housing 72. The housing 72 could be a separate member which is attached to the first member 40. The housing 72 is sized and shaped with an aperture 76 to allow the second end 68 of the second member to pass therethrough. The threads of the worm screw 74 are sized and shaped to engage the teeth 66 on the second member 42. When the screw 74 is rotated by a user, the second member 42 can be moved inward or outward relative to the aperture 76. Thus, the space between opposite sides of the surface 58 of the first member 40 and the inward facing surface of the second member 42 can be increased to decreased. When decreased, the members 40, 42 can clamp the post 22 directly therebetween to mechanically and electrically connect the first section 36 to the post 22.

Figure 5:
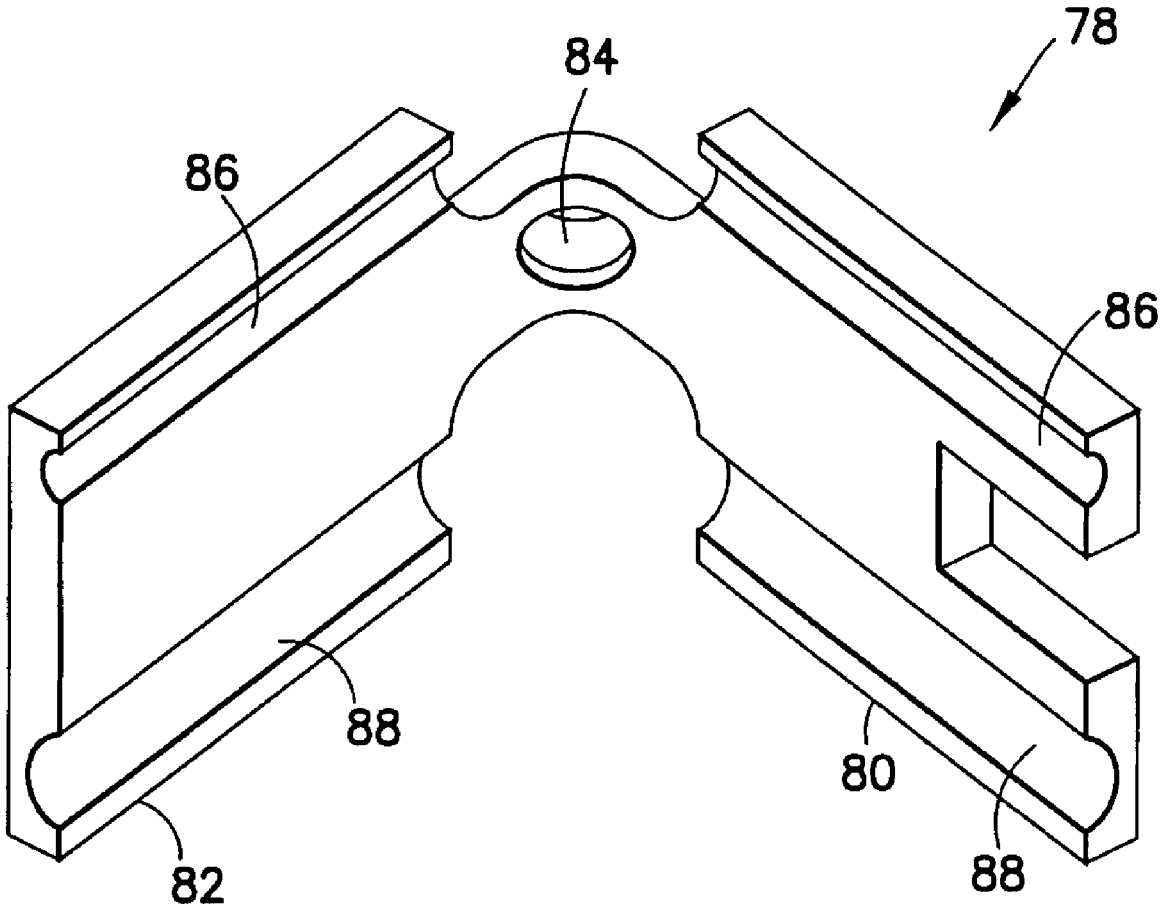
FIG. 5 is a perspective view of another one of the members of the connector shown in FIGS. 2-3.
Figure 6:
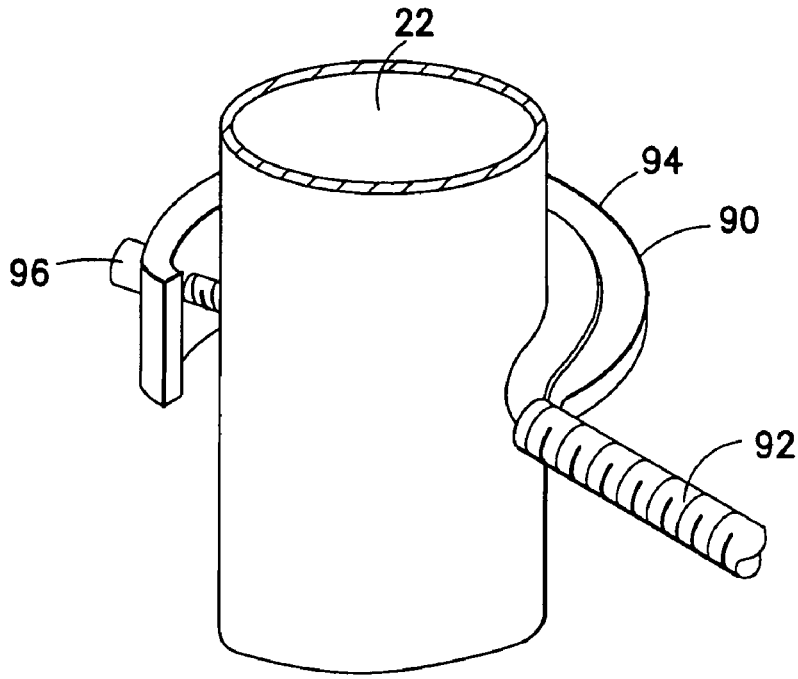
FIGS. 6-9 are perspective views an alternate embodiment of one of the sections of the connector shown in FIGS. 2-3.
Figure 7:
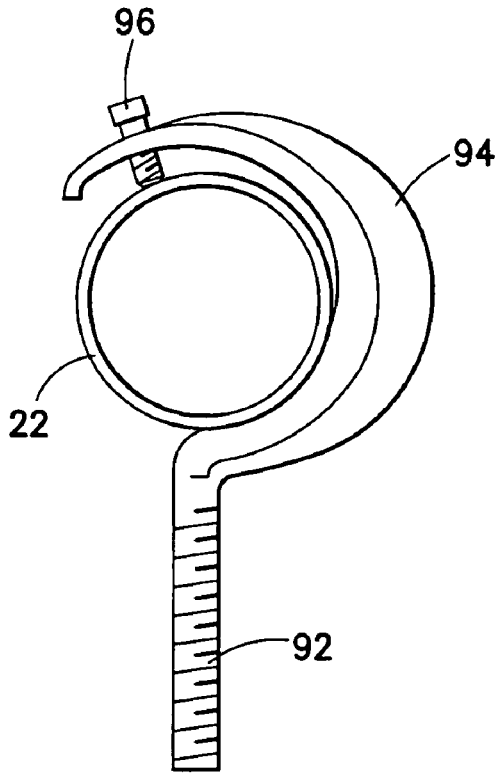
Figure 8:
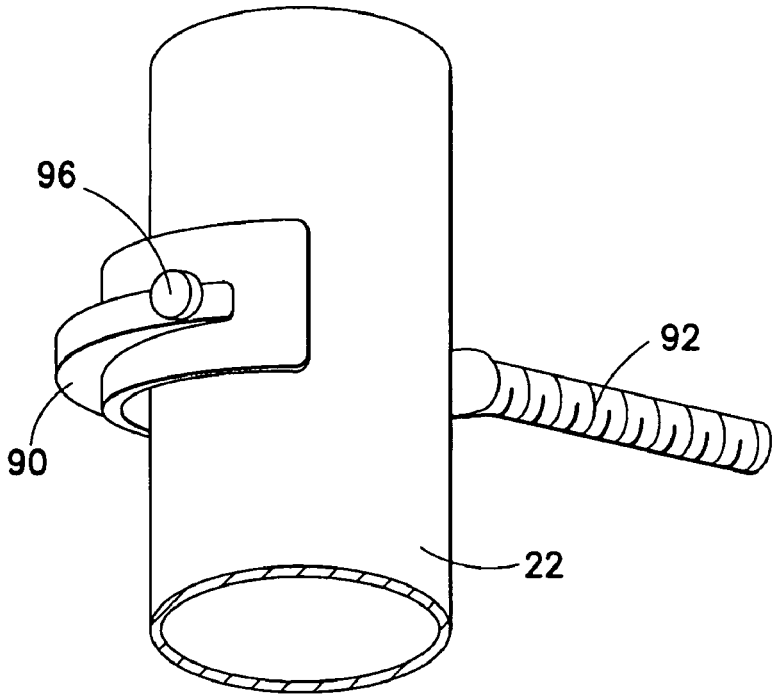
Figure 9:
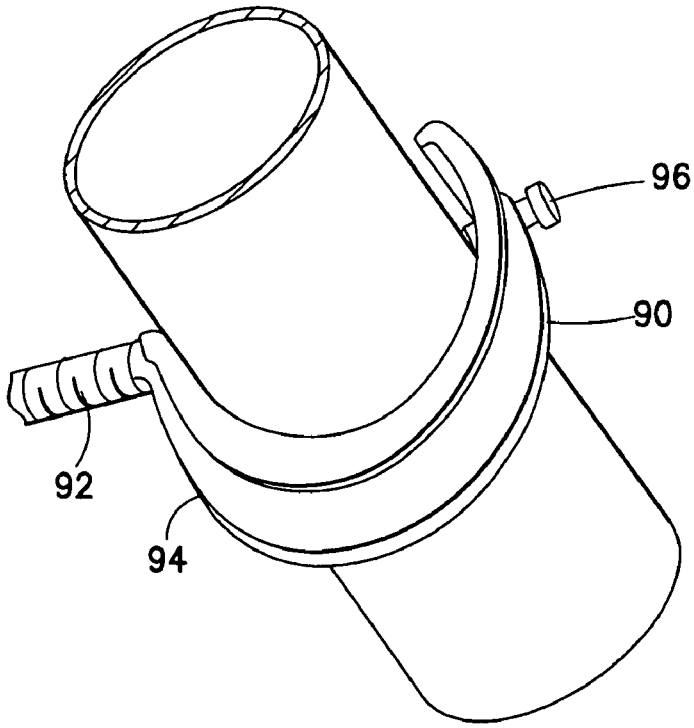

The second section 38 has a one-piece member 78 and a fastener 81 (see FIG. 2), such as a nut. Referring also to FIG. 5, the one-piece member 78 is preferably made of metal and comprises a general V shape with two generally orthogonal sections 80, 82 and a through-hole 84 between the two generally orthogonal sections. The post 46 is located through the through-hole 84. The inner facing sides of the sections 80, 82 comprise conductor receiving grooves 86, 88.

The conductors 30, 32 can be located in the grooves 54, 56, 86, 88 and the nut 81 tightened to clamp the conductors directly between the members 40, 78. Thus, the conductors 30, 32 can be electrically connected to each other and to the post 22.

Referring also to FIGS. 6-9, an alternate embodiment of the first section is shown connected to the post 22. In this embodiment the first section has a one-piece metal member 90 comprising a threaded post 92 and a general C shaped section 94. The threaded post 92 is located at a first end of the C shaped section 94. A screw 96 is connected to an opposite second end of the C shaped section 94. A tip of the screw 96 can be tightened directly onto post 22 to attached the member 90 to the post. The member 78 and nut 81 can be used on the threaded post 92 to clamp the conductors 30, 32 directly against the exterior side of the post 22.

With the invention, a ground connector can be provided comprising a first section comprising a first member 40 with a threaded post 46, a second member 42 pivotably connected to the first member, and a worm drive 44 on the first member 40, wherein the second member comprises teeth 66 configured to be engaged by the worm drive to clamp a pedestal directly between the first and second members; and a second section 38 movably located on the threaded post and configured to directly contact and clamp a conductor towards the pedestal.

The first member can comprise a general V shaped member 40 with an inner surface 58 sized and shaped to directly contact the pedestal, and outer surfaces having conductor receiving grooves 54, 56. The outer surfaces of the first member can comprise two surfaces which are generally orthogonal to each other. The second section can comprise a one piece member 78 having a general V shape with two generally orthogonal sections and a through-hole 84 between the two generally orthogonal sections, wherein the post 46 extends through the through-hole. The two generally orthogonal sections 80, 82 can have inward facing sides with conductor receiving grooves 86, 88 therealong. A fastener 81 on the post 46 can be configured to press the one piece member 78 towards the pedestal. The second member 42 can be a one piece member having a general curved shape with a first end pivotably connected to a first end of the first member, and a second end having the teeth thereon, and wherein the worm drive is rotatably connected to a second end of the first member.

A ground connector can be provided comprising a first section comprising a first member 40, 90 with a threaded post 46, 92, and a system comprising a screw 74, 96 configured to clamp the first section against opposite sides of a support 22; and a second section 42 movably located on the threaded post and configured to directly contact and clamp a conductor towards the support. The first member can be a one-piece member with a general C shaped section 94 and the threaded post extending from one end of the C shaped section, and wherein the screw is connected to an opposite second end of the general C shaped section, and wherein an end of the screw is located to directly contact the support.

A method can be provided comprising connecting a first section of a ground connector to a pedestal, wherein the first section comprises a first member with a threaded post, a second member pivotably connected to the first member, and a worm drive on the first member, wherein the second member comprises teeth engaged by the worm drive to clamp a pedestal directly between the first and second members; and positioning a second section on the threaded post to directly contact and clamp a conductor towards the pedestal.

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. A ground connector comprising:

a first section comprising a first member with a threaded post, a second member pivotably connected to the first member, and a worm drive on the first member, wherein the second member comprises teeth configured to be engaged by the worm drive to clamp a pedestal directly between the first and second members; and a second section movably located on the threaded post and configured to directly contact and clamp a conductor towards the pedestal.

2. A ground connector as in claim 1 wherein the first member comprises a general V shaped member with an inner surface sized and shaped to directly contact the pedestal, and outer surfaces having conductor receiving grooves.

3. A ground connector as in claim 2 wherein the outer surfaces of the first member comprises two surfaces which are generally orthogonal to each other.

4. A ground connector as in claim 1 wherein the second section comprises a one piece member having a general V shape with two generally orthogonal sections and a through-hole between the two generally orthogonal sections, wherein the post extends through the through-hole.

5. A ground connector as in claim 4 wherein the two generally orthogonal sections have inward facing sides with conductor receiving grooves therealong.

6. A ground connector as in claim 4 further comprising a fastener on the post configured to press the one piece member towards the pedestal.

7. A ground connector as in claim 6 wherein the first member comprises a general V shaped member with an inner surface sized and shaped to directly contact the pedestal, and outer surfaces having conductor receiving grooves.

8. A ground connector as in claim 1 wherein the second member is a one piece member having a general curved shape with a first end pivotably connected to a first end of the first member, and a second end having the teeth thereon, and wherein the worm drive is rotatably connected to a second end of the first member.

9. A ground connector comprising:

a first section comprising a first member with a threaded post, and a system comprising a screw configured to clamp the first section against opposite sides of a support; and a second section movably located on the threaded post and configured to directly contact and clamp a conductor towards the support.

10. A ground connector as in claim 9 wherein the first member comprises a general V shaped member with an inner surface sized and shaped to directly contact the support, and outer surfaces having conductor receiving grooves.

11. A ground connector as in claim 10 wherein the outer surfaces of the first member comprise two surfaces which are generally orthogonal to each other.

12. A ground connector as in claim 9 wherein the second section comprises a one piece member having a general V shape with two generally orthogonal sections and a through-hole between the two generally orthogonal sections, wherein the post extends through the through-hole.

13. A ground connector as in claim 12 wherein the two generally orthogonal sections have inward facing sides with conductor receiving grooves therealong.

14. A ground connector as in claim 12 further comprising a fastener on the post configured to directly press the one piece member towards the support.

15. A ground connector as in claim 14 wherein the first member comprises a general V shaped member with an inner surface sized and shaped to directly contact the support, and outer surfaces having conductor receiving grooves.

16. A ground connector as in claim 9 wherein the first section comprises a one piece second member having a general curved shape with a first end pivotably connected to a first end of the first member, and a second end having teeth thereon, and wherein the screw is rotatably connected to a second end of the first member such that threads of the screw engage the teeth.

17. A ground connector as in claim 9 wherein the first member is a one-piece member with a general C shaped section and the threaded post extending from one end of the C shaped section, and wherein the screw is connected to an opposite second end of the general C shaped section, and wherein an end of the screw is located to directly contact the support.

18. A method comprising:

connecting a first section of a ground connector to a pedestal, wherein the first section comprises a first member with a threaded post, a second member pivotably connected to the first member, and a worm drive on the first member, wherein the second member comprises teeth engaged by the worm drive to clamp a pedestal directly between the first and second members; and positioning a second section on the threaded post to directly contact and clamp a conductor towards the pedestal.

* * * * *